United States Patent [19]

Yasuda

[11] Patent Number: 4,478,232

[45] Date of Patent: Oct. 23, 1984

[54] NAIL POLISHER

[75] Inventor: Mieji Yasuda, Kashiwara, Japan

[73] Assignee: Nihon Keiki Co., Ltd., Osaka, Japan

[21] Appl. No.: 553,364

[22] Filed: Nov. 18, 1983

[30] Foreign Application Priority Data

Nov. 19, 1982 [JP] Japan ..... 57-204240

[51] Int. Cl.[3] ..... A45D 29/05

[52] U.S. Cl. ..... 132/73.6; 132/11 A; 132/75.6; 132/76.4

[58] Field of Search ..... 132/73.6, 75.6, 76.4, 132/11 A

[56] References Cited

U.S. PATENT DOCUMENTS 1,357,031 10/1920 Daugherty ..... 132/11 A
2,056,379 10/1936 Acocella ..... 132/73.6
2,880,737 4/1959 Tone et al. ..... 132/73.6
3,587,596 6/1971 Wolff ..... 132/73.6
4,326,314 4/1982 Moret ..... 132/11 A

*Primary Examiner*—Gregory E. McNeill
*Attorney, Agent, or Firm*—Koda and Androlia

[57] ABSTRACT

A nail polisher for filing and polishing the finger nails by a motor drive. The nail polisher includes a polishing cylinder and filing plates. The polishing cylinder is lined with a polishing layer in its inner surface and is driven to rotate, while the filing plates are driven to reciprocate in horizontal. A motor is used as driving source for the rotatory motion of the polishing cylinder and for the reciprocatory motion of the filing plates. With the nail polisher structured as above, the filing of finger nails is carried out automatically, making the operation to be done quickly and easily. Furthermore, the nails are polished evenly with beautiful results.

3 Claims, 2 Drawing Figures

FIG. 1
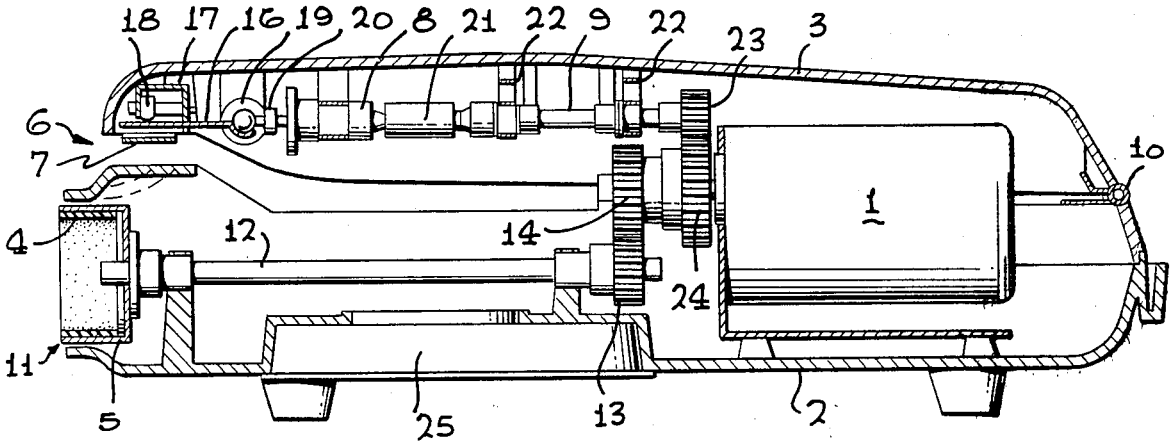
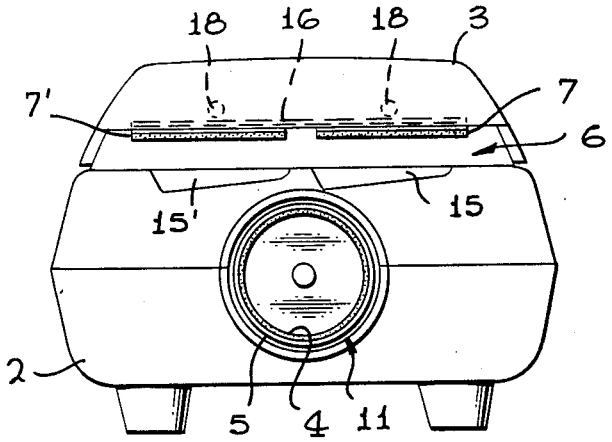
FIG. 2

NAIL POLISHER

BACKGROUND OF THE INVENTION

1. Field of the Invention

The present invention relates to a nail polisher for automatically filing and polishing the finger nails at home or in beauty shop, etc.

2. Prior Art

In the conventional practice, nail filing and nail polishing have all been performed by manual with the emery boards (papers), etc. Accordingly, it takes a long time to remove ridges, file, and polish the nail for finishing, which have to be worked out for each individual finger nail. Therefore, in the beauty shop, a lot of work load should be appropriated for such operations, resulting in a serious drawback in efficiency of overall work. Furthermore, the results of nail polishing by manual work varies depending on the skill and experience of the individual. Hence, when the nail polishing is done by oneself at home or by unskilled manicurist, the finished work does not always come out satisfactory.

SUMMARY OF THE INVENTION

The object of the present invention, therefore, is to provide a nail polisher which files and polishes the finger nails quickly and easily with beautiful results.

In keeping with the principles of this invention, the objects of this invention are accomplished by a unique structure for a nail polisher which includes a polishing cylinder and and filing plates. The polishing cylinder is provided with a polishing layer in its inner circumferential surface and is rotated, while the filing plates are driven to reciprocate in horizontal. A motor is used as a driving source for the rotatory motion of the polishing cylinder and for the reciprocatory motion of the filing plates which file and polish the nails.

BRIEF DESCRIPTION OF THE DRAWINGS

FIG. 1 is a longitudinal sectional view showing the internal structure of an embodiment of the present invention; and FIG. 2 is a front view showing the installing positions of the filing plates and a polishing cylinder thereof.

DETAILED DESCRIPTION OF THE INVENTION

In the nail polisher of this invention, a motor 1, driving source, drives a polishing (buffing) cylinder 5 to rotate and filing plates 7 to reciprocate. The motor 1 is encased in a case body 2. The case body 2 is provided with a cover 3 which is in a manner to open and close with its rear end as the center of such movements. The motor 1 is actuated or stopped by an on/off switch installed in the case body 2. Both the case body 2 and the cover 3 are made of plastics, and are shaped to be long in longitudinal direction. Also, the rear ends of the case body 2 and the cover 3 are joined by a hinge 10. The motor 1 is installed at the rear section of the case body 2 in a manner that the driving shaft of the motor 1 sticks out toward the front. A round window 11 is formed on the front face of the case body 2. A polishing cylinder 5 positions in this window 11. The polishing cylinder 5 is in a bottomed cylinder form, and a turning shaft 12 is fixed to the bottom facing rear. Over the inner surface of the polishing cylinder 5 is formed with a polishing layer 4. The turning shaft 12 is connected at its rear end to the driving shaft of the motor 1 through gears 13 and 14.

The cover 3 is designed so as to form a gap between its front end and the front end of the case body 2 when it is closed. In addition, the case body 2 is provided with recessions 15 and 15' at its upper front edge. The above-mentioned gap and these recessions 15 and 15' form finger tip inserting spaces 6 and 6'. Inside of the cover 3 are provided with transmission shafts 8 and 9 which come to be engaged with the motor 1 when the cover is closed. Filing plates 7 and 7' are fixed to a sliding plate 16, and this sliding plate 16 is held in a freely slidable manner by a supporting frame 17 which is installed to the internal surface of the cover 3.

The filing layer of the filing plate 7' is formed finer in grain of its abrasive surface than that of filing layer of the filing plate 7. The polishing surface 4 of the inner circumferential surface of the polishing cylinder 5 is further finer in grain than that of the filing plate 7'.

A roller 18 is mounted on a supporting frame 17, and it comes to be rotatingly in contact with the sliding plate 16. A rod 19 is attached to the rear end of the sliding plate 16. This rod 19 is interlockingly coupled with one of the transmission shafts 8 through a crank 20. In other words, the rotatory drive of the transmission shaft 8 is converted into linear reciptocatory motion by means of the crank 20 so as to drive the rod 19 right and left. As a means to interlock the transmission shaft 8 and the rod 19, an eccentric may be used instead of the foregoing crank 20. In other words, as far as a mechanism for converting a rotatory motion into a linear reciprocation is provided, it will suffice the purpose.

The above-mentioned transmission shafts 8 and 9 are connected by a universal joint 21. The transmission shaft 9, being at the rear end, is held in the internal surface of the cover 3 by means of a bearing 22. A gear 23 is fixed to the rear end of the transmission shaft 9. This gear 23 is designed to engage with the upper portion of a gear 24 of the drive shaft of the motor 1 when the cover 3 is closed. As a result, the transmission shaft 9 comes to be interlocked with the transmission shaft of the motor 1 when the cover 3 is closed.

In operation, when the motor 1 is actuated to rotate with the cover 3 in the closed state, the truning shaft 12 rotates so that the polishing cylinder 5 rotates. Also, the transmission shafts 8 and 9 are driven to rotate, reciprocating the filing plates 7 right and left. When a finger tip is inserted with its nail up into the finger tip inserting space 6, the filing plate 7 comes to contact with the nail with sliding motion and files the nail. The filing plate 7 has a slightly coarse abrasive layer and smooths the nail surface by removing its ridges. Then, when the nail is brought into the finger tip inserting space 6', the filing plate 7', having finer abrasive surface than the filing plate 7, files the nail surface smoother. In this case, if the finger tip is thicker or the finger tip is inserted deeper into the space for inserting the finger tip, the whole body of the cover 3 is lifted slightly. As a result, the filing plates 7 and 7' are caused to recede upward. In this manner, the contact pressure of the filing plates 7 and 7' to the nail is maintained to be adequate in degree. Furthermore, compared to the lifting extent of the front end of the cover 3, the lifting extent of the gear 23 which is at the rear end of the transmission shaft is very slight. Besides, the universal point 21 is provided between the both transmission shafts 8 and 9. Consequently, the gears 23 and 24 are kept engaged to each other. Also, when the cover 3 is lifted further, the engagement between the gears 23 and 24 is released and the rotation of the transmission shafts 8 and 9 as well as the reciprocation of the filing plates 7 and 7' are halted.

Next, when the finger tip is inserted into the polishing cylinder 5 and the nail is brought to come to contact with the polishing layer 4, the nail is further polished to become shiny by being rubbed with the sliding motion of the polishing layer 4 which has the finest grain. If the motor 1 is designed to rotate in both normal and reverse directions instead of rotating only one direction, the rotational direction of the polishing cylinder becomes reversible, resulting in more even polishing action.

As described above, according to the nail polisher of this invention, by merely inserting the finger tip into the finger tip inserting space formed between the cover and the case body the rough filing including the removal of ridges (reedy lines) is performed by the filing plates. Further, the nail is polished and buffed to be glossy by bringing the finger tip to come into contact with the polishing layer formed in the polishing cylinder. Thus, the nail is filed automatically without troublesome labors found in an existing practice. In addition, the nail polishing work is performed quickly and easily. Moreover, since the filing plate is adjustably moved up and down to minute extend in accordance with the position of the finger nail, the contact pressure applied by the filing plate to the finger nail is maintained appropriately all the time, enabling to automatically carry out the nail filing to the proper degree without overdoing or underdoing. On the other hand, since the polishing layer is provided on the inner surface of the polishing cylinder, the polishing layer comes to contact with the nail surface evenly in sliding motion, achieving a beautiful finish.

As should be apparent from the foregoing description, with the nail polisher of the present invention, nail polishing can be done by oneself. Further, the beautiful result is obtainable by any person. Therefore, this also offers an effective solution for shortening the time to wait in beauty salons.

I claim:

1. A nail polisher comprising:

a case body having therein a single motor;

a cover provided on the case body in a manner to be opened/closed with its rear end as the center of such motion;

a polishing cylinder formed with a polishing layer on its inner surface, said cylinder being at the front portion of the case body in a manner to be rotated by the single motor;

a finger tip inserting space formed between the front end of the case body and the front end of the case;

filing plates which are driven to reciprocate horizontally above the finger tip inserting space, and transmission shafts which reciprocate the filing plates through a converting mechanism, said filing plates and transmission shafts being provided in the cover so that the transmission shafts connect to the single motor when the cover is closed.

2. A nail polisher according to claim 1, wherein said converting mechanism is a crank.

3. A nail polisher according to claim 1, wherein said converting mechanism is an eccentric.

* * * * *